United States Patent [19]

Innes et al.

[11] Patent Number: 4,733,598

[45] Date of Patent: Mar. 29, 1988

[54] TELESCOPIC JIB

[75] Inventors: Gordon Innes, Letchworth; Robert B. Bishop, Pirton, Nr Hitchin, both of England

[73] Assignee: The 600 Group PLC, Middlesex, England

[21] Appl. No.: 876,221

[22] Filed: Jun. 19, 1986

[30] Foreign Application Priority Data

Jun. 21, 1985 [GB] United Kingdom ..... 8515782

[51] Int. Cl.[4] ..... F15B 11/18

[52] U.S. Cl. ..... 91/168; 91/167 R; 91/167 A

[58] Field of Search ..... 91/167 R, 167 A, 168

[56] References Cited

U.S. PATENT DOCUMENTS 3,188,917 10/1962 Quale ..... 91/168

3,734,464 5/1973 Bushnell, Jr. ..... 91/168

3,754,666 8/1973 Suverkrop ..... 91/167 R 3,882,759 5/1975 Formwalt et al. ..... 91/167 R

*Primary Examiner*—Robert E. Garrett

*Assistant Examiner*—Thomas E. Denion

*Attorney, Agent, or Firm*—McCormick, Paulding & Huber

[57] ABSTRACT

A telescopic device for use in a crane jib, forklift truck, lighting tower, access platform or the like, having at least two extandable sections extending from a base section, in which each said extendable section is extended by a piston and cylinder assembly and in which, to extend the device, a similar hydraulic pressure is applied in the extension mode to all the assemblies and different hydraulic pressures are caused to exist in all the assemblies in the retraction mode, so that a selective extension sequence of the sections is effected.

3 Claims, 7 Drawing Figures

TELESCOPIC JIB

This invention relates to telescopic devices such as crane jibs, forklift truck masts, lighting towers and access platforms.

A telescopic crane jib basically comprises three sections known as the base section, which is pivotally connected to a vehicle structure and may be positioned by rotating the structure about a vertical axis and raising or lowering the base section about its pivot by a ram; an intermediate section which, when retracted, lies within the base section; and a head section which, when retracted, lies within the intermediate section.

Current designs of three-section telescopic jibs for cranes fall generally into four categories:

1. Those which use two separately controlled hydraulic piston and cylinder assemblies (hereafter, an hydraulic piston and cylinder assembly will simply be referred to as an "assembly") involving the use of hose reeling drums to serve the head section assembly and relying on the operator to deploy correctly the jib sections in the correct sequence.

2. Those which use two interconnected assemblies which eliminates the need for a hose reel but allows the jib sections to extend in a random sequence. This design has the disadvantage that the ratings of the crane are restricted to those achievable with the weakened jib deployment format. A further disadvantage is that the ratings are restricted to those achievable with the least advantageous deployment of the jib from a stability viewpoint. This dual restriction appreciably reduces the loading capacity which can be claimed.

3. Those using only a single assembly with the head section actuated by chain or rope double-up arrangement similar to that which is common on forklift trucks. In this design, the deployment of the jib is uniform and predictable and close to the optimum from a strength and stability viewpoint but the disadvantage is that there is a considerable amount of mechanism, such as rollers, sheaves, chains or ropes, inside the jib where they are inaccessible for maintenance and inspection.

4. Those with two cylinders, similar to 2 above and using a mechanical synchronizing device using ropes or chains. This device has a similar disadvantage to 3 above.

Category 2 above is currently preferred but it reduces the permitted duties of the crane. There is, therefore, a need for an arrangement which permits selective phasing of the extensions of the head and intermediate sections so that either:

a. the intermediate section carries the head section with it and extends first after which the head section extends. On retraction, the head section retracts first after which the intermediate section retract; or b. the head section fully extends first and then the intermediate section extends. On retraction, the intermediate section retract first after which the head section retracts.

Method a above achieves the strongest deployment of the jib but is the worst from the viewpoint of overturning moment on the crane due to jib mass. It is therefore appropriate in crane design where strength is the principal factor in deciding ratings.

Method b above is the weakest deployment of the jib but reduces the overturning moment due to jib mass and is therefore appropriate to cranes where stability is a deciding factor in ratings.

OBJECT OF THE INVENTION

It is the main object of this invention to provide a telescopic jib for a crane in which the phasing of the extension of the sections can be determined.

STATEMENT OF INVENTION

According to the present invention there is provided a telescopic device having at least two sections extendable from a base section, in which each said extendable section is extended by an assembly and in which, to extend the device, a similar hydraulic pressure is applied in the extension mode to all the assemblies and different hydraulic pressures are caused to exist in all the assemblies in the retraction mode, so that a selective extension sequence of the sections is effected.

The said different hydraulic pressures may be caused to exist in the retraction mode by the provision of different pressure areas on the retraction side of the pistons of the assemblies. Alternatively, the different hydraulic pressures may be brought about by the use of pressure reducing valves.

DRAWINGS

Figure 2:
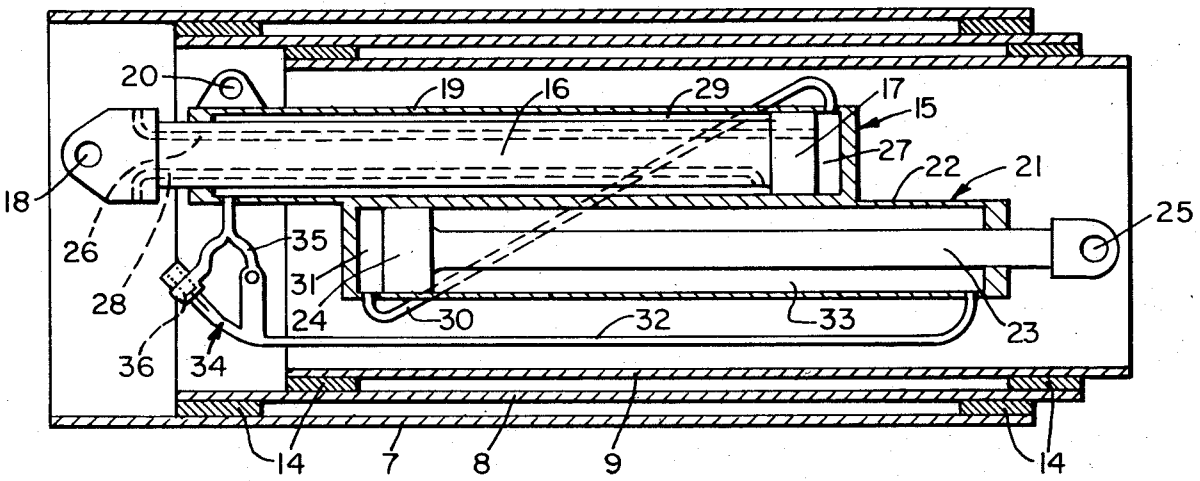
FIG. 2 is a schematic sectional view of a jib with three sections and assemblies constructed in accordance with the invention.
Figure 4A:
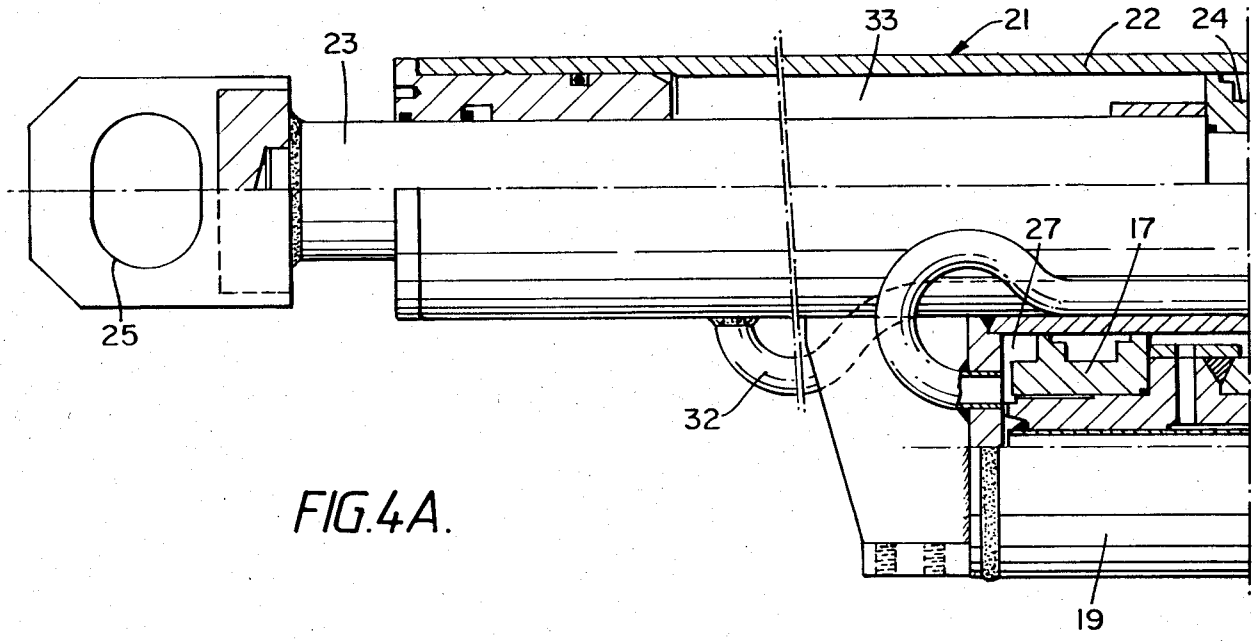
Figure 4B:
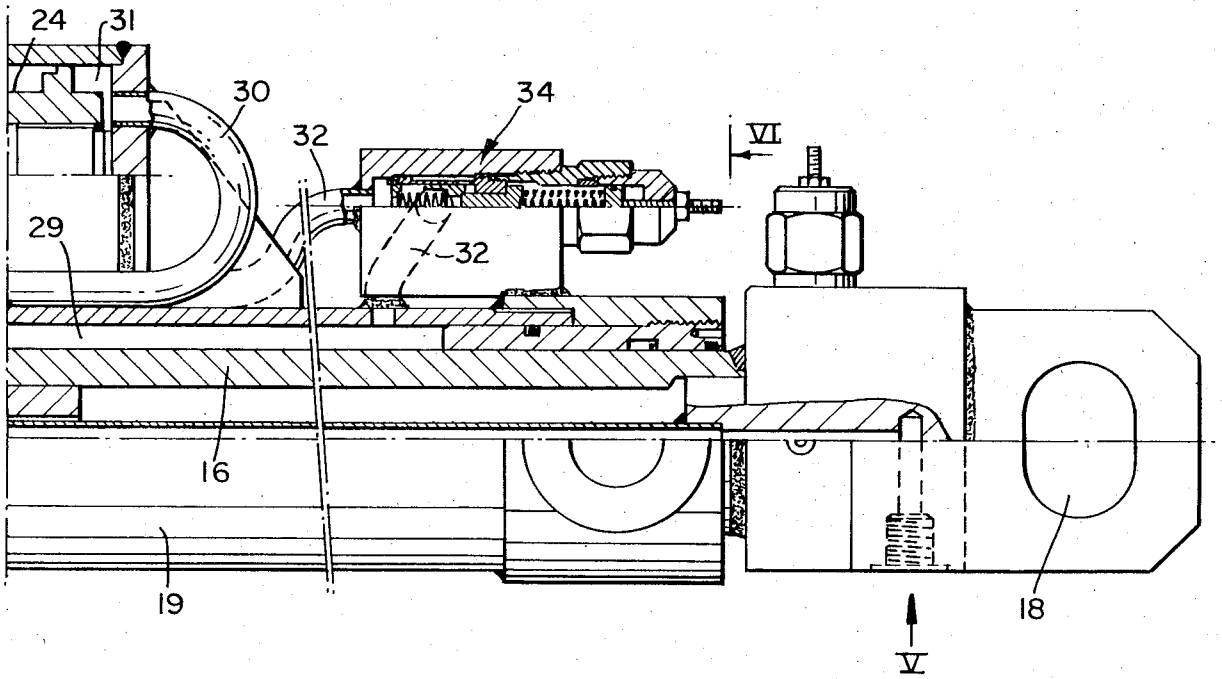
Figure 5:
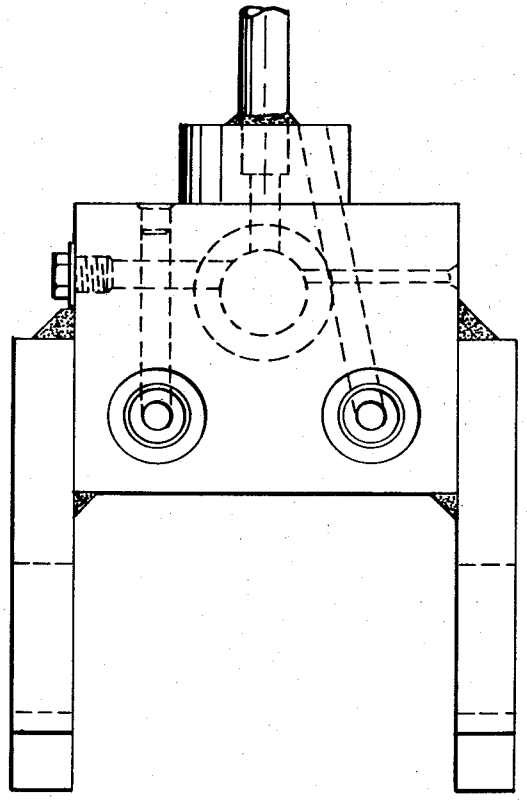
Figure 6:
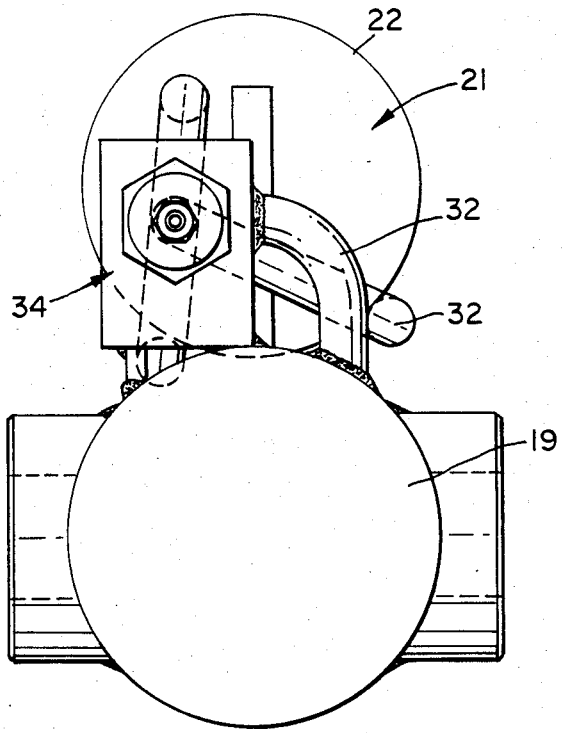

FIGS. 4 A+B are a part sectional side view of the assemblies of FIG. 2;

FIG. 5 is a scrap view looking in the direction of arrow V of FIG. 4; and FIG. 6 is a scrap view looking in the direction of arrow VI of FIG. 4.

SPECIFIC DESCRIPTION

Figure 1:
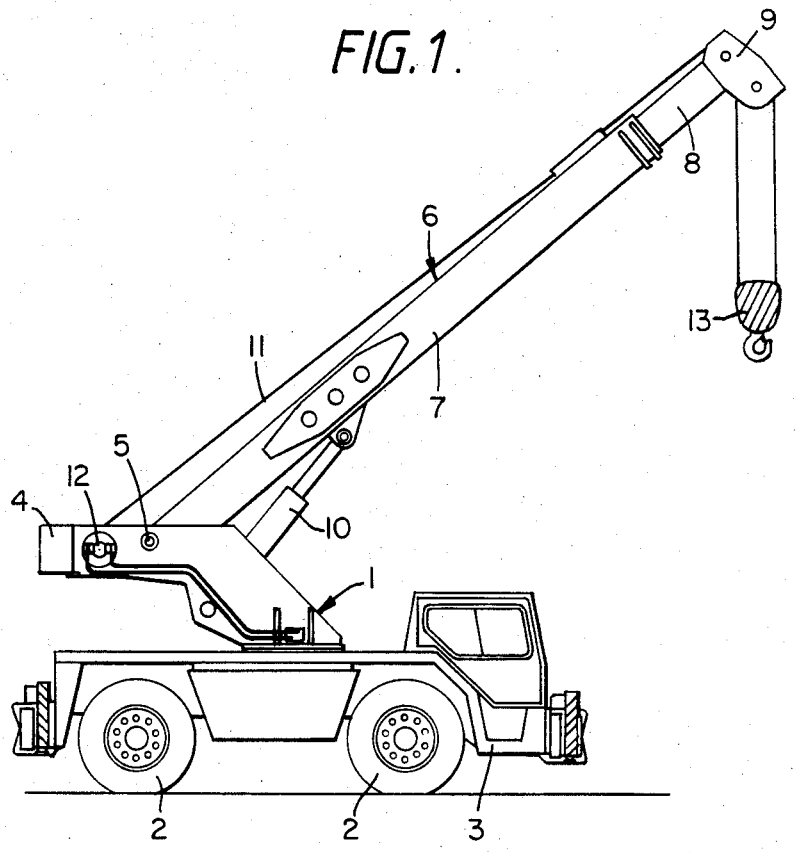
FIG. 1 is a side elevation of a typical crane having an hydraulically extending and retracting jib.

Referring first to FIG. 1, a typical mobile crane 1 has road wheels 2 supporting a chassis 3 on which is mounted, for rotation about a vertical axis, a jib support unit 4. This support unit 4 carries, for rotation about pivot 5, a telescopic jib 6 having a base section 7, an intermediate section 8 and a head section 9. The jib 6 is raised and lowered by ram 10 and the outer end of the head section 9 carries sheaves over which runs a cable 11 from a winch 12 for controlling a hook block 13.

For extending the intermediate section 8 and head section 9 there is provided a double assembly shown in FIG. 2. These assemblies are physically connected but operate as two separate units.

Illustrated in FIG. 2 are the base, intermediate and head sections 7, 8 and 9 respectively, which would normally be of box section, the inner sections sliding between themselves and within the base section on low friction pads 14. First assembly 15 has its piston rod 16, which extends from piston 17, connected to base section 7 by pin 18. Cylinder 19 of first assembly 15 is connected to intermediate section 8 by pin 20. Second assembly 21 has its cylinder 22 welded to cylinder 19 of first assembly 15 and its piston rod 23, which extends from piston 24, connected to head section 9 by pin 25.

The diameter of rod 16 is greater than the diameter of rod 23.

Pipe or duct 26 (hereinafter the means of conveying hydraulic pressure will be called a "pipe") conveys hydraulic pressure in the extension mode to chamber 27 in assembly 15, and pipe 28 conveys hydraulic pressure in the retraction mode to chamber 29. Chamber 27 is connected by pipe 30 to chamber 31 for conveying hydraulic pressure in the extension mode to second assembly 21 and pipe 32 connects chamber 29 to chamber 33 of second assembly 21 to convey hydraulic pressure in the retraction mode. In pipe 32 is a compound valve 34 to give free flow through branch 35 when extending so that the pressures in chambers 29 and 33 are equal, and a pressure drop through a spring loaded relief valve 36 when retracting.

In the construction described above, to extend the jib, hydraulic pressure is applied to pipe 26 in the extension mode and a back pressure of less than half of the extension mode pressure is applied to pipe 28 in the retraction mode. Because of the differential retraction mode annuli of pistons 17 and 24, there will be a nett extension pressure greater in assembly 15 than in assembly 21 and thus the intermediate section will extend first carrying the head section with it. On complete extension of the intermediate section the head section will then extend.

To retract the jib, hyraulic pressure is applied to pipe 28 and a back pressure of at least one fifth of the retraction mode pressure is applied to pipe 26. Because the annulus area of piston 24 exceeds the annulus area of piston 17, the head section 9 will move preferentially. When the head section is fully retracted, the intermediate section will then retract.

FIGS. 4, 5 and 6 show the assemblies of FIG. 2 in more detail and like reference numbers have been used for like parts.

It will be appreciated by one skilled in the art that to configure a jib so that the head section extends first and also retracts first, the relative areas of the annuli of the pistons in the retraction mode must be reversed.

Figure 3:
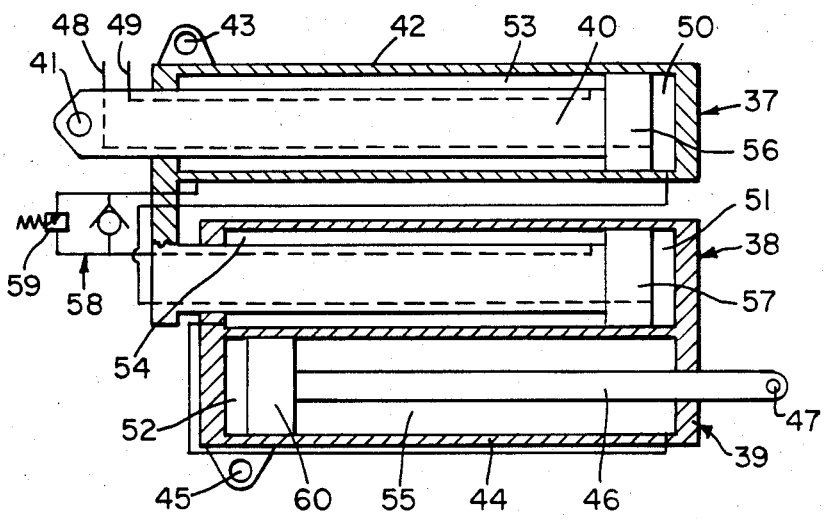
FIG. 3 is a schematic sectional view of a further form of jib with four sections and assemblies constructed in accordance with the invention.

In FIG. 3 there is illustrated schematically a four section jib with the assemblies being connected in cascade. Such a device would be relevant if a stinger or other extension of the head section was incorporated.

The embodiment of FIG. 3 includes first, second and third assemblies 37, 38 and 39 respectively, the first assembly 37 having its piston 40 attached by pin 41 to the base section of the jib, its cylinder 42 attached by pin 43 to the intermediate section, the cylinder 44 of the third assembly 39 (which is welded to second assembly 38) attached to the head section by pin 45 and the piston rod 46 of assembly 39 attached to the stinger section by pin 47.

Pipes 48 and 49 for hydraulic pressure are provided for the extension and retraction modes respectively. Extension mode chambers 50, 51 and 52 are interconnected as are retraction mode chambers 53, 54 and 55. Piston 56 of assembly 37 and piston 57 of assembly 38 have the same retraction mode annuli areas but the pipe connecting chambers 53 and 54 incorporates a compound valve 58 incorporating a relief valve 59 to provide differential pressure in chambers 53 and 54 on extension. Retraction mode chamber 54 is connected to retraction mode chamber 55 of assembly 39 but piston 60 of assembly 39 has a larger retraction mode annulus area than the other two assemblies.

It will be appreciated that this arrangement operates in cascade in that on hydraulic pressure being applied to pipe 48 in the extension mode and back pressure of less than half the extension pressure being applied to pipe 49, assembly 37 will extend first, then assembly 38 will extend and finally assembly 39 will extend. On retraction and the pressure in pipe 49 being the operational pressure and back pressure being applied to pipe 48, the stinger will retract first, then the head section and finally the intermediate section.

A reversal of the extension and retraction format can be achieved in accordance with the invention by suitable variation of the retraction mode annuli areas and/or the incorporation of pressure reducing valves. Also, more than four extending jib sections may be involved using the principle of the invention.

We claim:

1. In a hydraulically operated telescoping boom structure for a crane or the like wherein said structure includes at least a boom base member pivotably mounted on a platform for movement about a horizontal axis, and includes at least one intermediate boom member slidably received in said base boom member as well as a head boom member slidably received in the intermediate boom member, and also includes hydraulic means for moving said members in a predetermined sequence during extension and in inverse order during retraction, the improvement to said hydraulic means comprising:

a first fluid motor having a motor part (16) connected to said boom base member (7) and another motor part (19) movable relative to said motor part (16) and connected to said intermediate boom member (8), a second fluid motor having a motor part (22) connected to said first fluid another motor part (19) and said second fluid motor having another motor part (23) connected to said head boom member (9), said first fluid motor having an extension chamber (27) connected to a source of incompressible fluid pressure, and said second fluid motor having an extension chamber (31) connected to said first fluid motor extension chamber by a pressure line (30), said first fluid motor having a retraction chamber (29) connected to a return line (28) associated with a reservoir for said fluid pressure source, said second fluid motor having a retraction chamber (33) connected to said first fluid motor retraction chamber by an intermediate return line (32), said first and second fluid motor extension chambers having cross sectional areas of substantially similar size and said second retraction chamber having a smaller cross sectional size than of that of said first retraction chamber, valve means (34) in said intermediate return line (32) responsive to back pressure in said intermediate return line to prevent fluid from flowing back to said fluid pressure source through said first retraction chamber until a predetermined back pressure has been exceeded in said second fluid motor retraction chamber.

2. The combination of claim 1 wherein said first fluid another part (19) comprises a cylinder and said second fluid motor part (22) also comprising a cylinder, said cylinder secured to one another so that said first fluid motor part (16) and said second fluid another motor part (23) comprise actuators movable in opposite directions relative to one another in response to fluid pressure to said extension chambers.

3. The combination of claim 2 further including a third fluid motor part (37) having a cylinder (42) secured to said second fluid and another motor part (23/57) and an actuator part (40) of said third fluid motor part (37) adapted to move a second intermediate telescopic member to which said actuator part (40) is connected (41).

* * * * *